United States Patent [19]

Schulze

[11] Patent Number: 5,038,673

[45] Date of Patent: Aug. 13, 1991

[54] HIGH-PRESSURE CLEANING APPARATUS WITH A WOBBLE PLATE PISTON PUMP

[75] Inventor: Werner Schulze, Winnenden, Fed. Rep. of Germany

[73] Assignee: Alfred Karcher GmbH & Co., Fed. Rep. of Germany

[21] Appl. No.: 391,501

[22] PCT Filed: Nov. 26, 1987

[86] PCT No.: PCT/EP87/00730

§ 371 Date: Jul. 24, 1989

§ 102(e) Date: Jul. 24, 1989

[87] PCT Pub. No.: WO88/05866

PCT Pub. Date: Aug. 11, 1988

[30] Foreign Application Priority Data

Jan. 28, 1987 [DE] Fed. Rep. of Germany ..... 3702446

[51] Int. Cl.[5] ..... F01B 3/00

[52] U.S. Cl. ..... 92/71; 91/499; 92/248

[58] Field of Search ..... 92/71, 73, 255, 172, 92/248, 260, 241, 254; 91/499, 500, 502, 504, 505

[56] References Cited

U.S. PATENT DOCUMENTS

| | | | |
|---|---|---|---|
| 2,285,476 | 6/1942 | Wahlmark | 92/71 |
| 2,405,938 | 8/1946 | Beeh | 92/255 |
| 2,956,845 | 10/1960 | Wahlmark | 92/256 |
| 3,187,644 | 6/1965 | Ricketts | 92/248 |
| 3,507,584 | 4/1970 | Robbins, Jr. . | |
| 3,514,223 | 5/1970 | Hare | 91/499 |
| 4,583,921 | 4/1986 | Wolff et al. | 417/269 |
| 4,741,254 | 5/1988 | Taylor | 92/248 |

FOREIGN PATENT DOCUMENTS

| | | | |
|---|---|---|---|
| 149219 | 7/1985 | European Pat. Off. . | |
| 1033028 | 6/1958 | Fed. Rep. of Germany . | |
| 3238667 | 4/1984 | Fed. Rep. of Germany . | |
| 242606 | 9/1969 | U.S.S.R. | 92/172 |

*Primary Examiner*—Edward K. Look
*Assistant Examiner*—Christopher M. Verdier
*Attorney, Agent, or Firm*—Barry R. Lipsitz

[57] ABSTRACT

In order to produce a high-pressure cleaning apparatus with a wobble plate piston pump which is of less expensive and more wear-resistant design, it is proposed that the piston be made of ceramic and carry a metallic contact element in the region where it contacts the wobble plate.

19 Claims, 4 Drawing Sheets

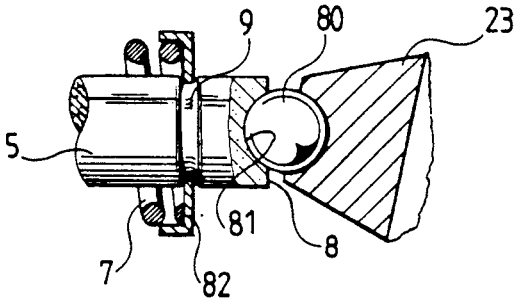
Fig. 9
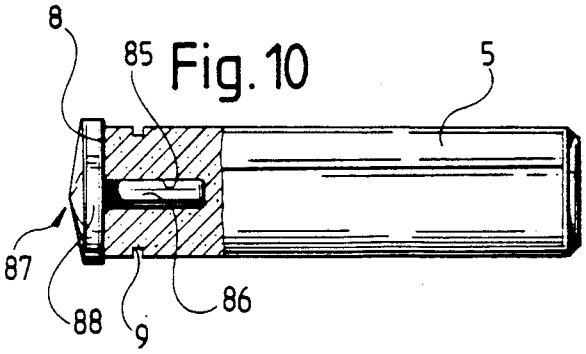
Fig. 10
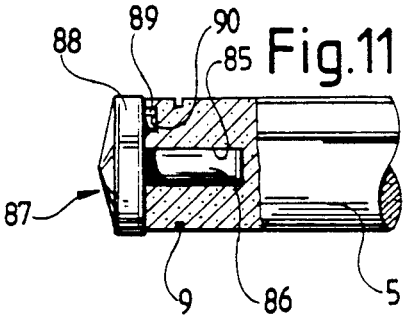
Fig. 11
Fig. 12
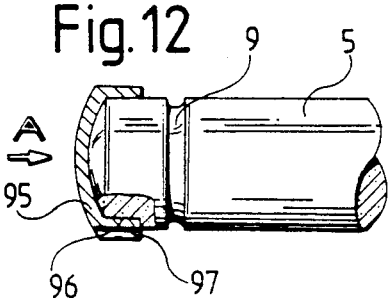
Fig. 13
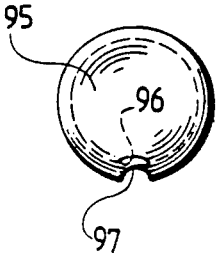
Fig. 14
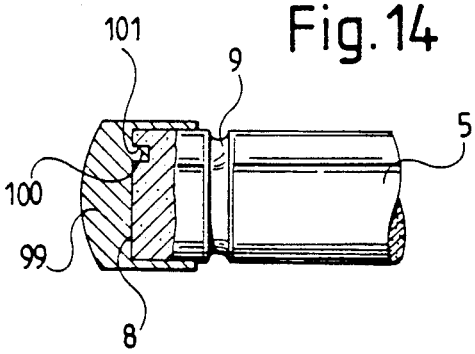
Fig. 3b
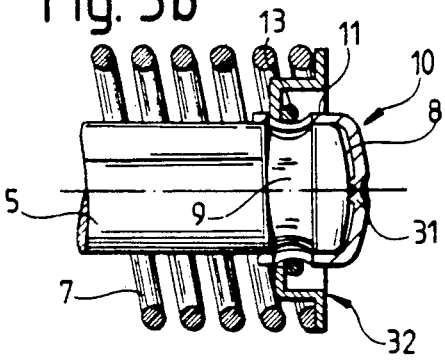

HIGH-PRESSURE CLEANING APPARATUS WITH A WOBBLE PLATE PISTON PUMP

The present invention relates to a high-pressure cleaning apparatus with a wobble plate piston pump.

The pistons of such wobble plate piston pumps undergo very high accelerations in the axial direction and, therefore, the high acceleration forces occurring with the use of conventional steel pistons result in a high degree of wear in the region of contact between piston and wobble plate. In a known wobble plate piston pump, the piston is of two-piece design, with the first and smaller part of the piston being made of ceramic and extending into the pump chamber, and the second and larger part of the piston being made of metal and being in contact with the wobble plate (EP-A No. 0 149 219). Owing to this design, very large acceleration forces also occur with these pistons.

The object of the invention is to so design a wobble plate piston pump, in particular, for a high-pressure cleaning apparatus that the acceleration forces are reduced and, at the same time, the degree of wear in the region of contact remains minima.

This object is achieved in accordance with the invention in a wobble plate piston pump of the kind described at the beginning by the characterizing features of patent claim 1.

Owing to the entire piston being made of ceramic, it is possible to manufacture pistons with a low mass, which keeps the acceleration forces low. In spite of this, the wear in the region of contact can be reduced by suitable selection of the metallic material of the contact element arranged between piston and wobble plate. More particularly, the very hard ceramic material can thereby be prevented from rubbing against the wobble plate.

The cap-shaped contact element may have a central spacer element which is supported on the front face of the piston so that the remaining cap regions are spaced from the front face of the piston. These cap regions which are not in contact with the front face are then elastically deformable to a slight extent so that hard knocks occurring during the rapid pressure build-up when the valves open and close can be compensated.

It is advantageous to secure the contact element against rotation about the longitudinal axis of the piston by positive engagement in the front face or the skirt of the piston. Wear in the region of contact between contact element and piston is thereby avoided.

The disc-shaped contact element may have a central shaft which penetrates a central blind hole in the piston.

In a particularly preferred embodiment, provision is made for the piston to have at its end near the wobble plate a circumferential groove in which the contact element and/or a supporting element is held for a spring which presses the piston against the wobble plate. This circumferential groove enables positive fixing of the above-mentioned parts in the axial direction without, for example, any necessity for screw or adhesive connections. In this case, it is also particularly advantageous that the machining of the piston is considerably simplified. For example, the groove may be made in a simple cutting operation prior to the firing. Centerless and, consequently, low-cost grinding of the piston itself is carried out subsequently. Thereupon the machining of the piston itself is already completed and it is unnecessary for the piston itself to be further modified in addition for the connection of metal caps, etc. It is, of course, also possible for grinding of the circumferential groove into the piston to be carried out after the firing.

An expedient embodiment is obtained by the contact element being pressed against the front face of the piston by a holding element surrounding the piston end and by the holding element engaging the circumferential groove in order to axially fix it on the piston. A two-piece design is thereby obtained and by using a separate holding element it is possible to connect different contact elements with one and the same piston.

It is particularly advantageous for the contact element, the supporting element or the holding element to cover the circumferential groove on the outside and for a clamping ring which presses the wall portions covering the circumferential groove into the circumferential groove to be fitted over the contact element, the supporting element or the holding element in this region of coverage. This enables particularly simple fixing on the piston. Merely by fitting the clamping ring, the wall material covering the circumferential groove is pulled gently into the circumferential groove and thereby fixes the corresponding parts on the piston. In this case, it is particularly advantageous that there are no sharp edges in the circumferential region as this reduces the danger of tension cracks.

Provision may be made for the wall of the contact element, of the supporting element or of the holding element to have longitudinal slots in the region in which the circumferential groove is covered. The shaping of the wall portions into the circumferential groove under the action of the clamping ring is thereby facilitated.

It is especially expedient for the clamping ring to be a shrunk-on metal ring which is preferably attached by a thermal shrinking-on operation.

In another preferred embodiment, provision is made for the contact element, the supporting element or the holding element to have detent projections which snap into the circumferential groove when it is pushed onto the piston. In a further embodiment, the stop element, the supporting element and/or the holding element itself is shrunk onto the piston end and these parts engage the circumferential groove in the shrunk-on state. With this design there is no need for use of separate clamping rings.

It is, furthermore, expedient for the contact element or a holding element of the contact element and the supporting element for the spring to be of one-piece design. Provision may, for example, be made for the contact element in the form of a metal cap fitting over the front face of the piston to have on the side of the circumferential groove facing away from the front face of the piston a radially protruding flange as supporting element.

In a further preferred embodiment, provision is made for the piston to be of spherical design at its end near the wobble plate and for it to be embraced by a sliding block acting as contact element. In this case, it is advantageous for the spherical end to have a constriction and for the sliding block to surround the spherical end up to the constriction so the sliding block is permanently connected to the spherical end of the piston.

An increase in the strength characteristics of the ceramic piston can be achieved by a reinforcement inlay being embedded in the ceramic piston. This may, for example, consist of steel filaments or glass fibers extending parallel to one another.

The following description of preferred embodiments serves in conjunction with the drawings to explain the invention in further detail. In the drawings.

Figure 2:
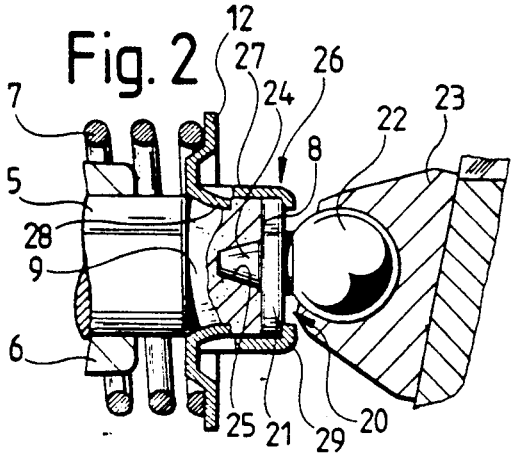
FIG. 2 is a view of the region where a piston contacts the wobble plate in a further embodiment with a contact element of spherical design.
Figure 5:
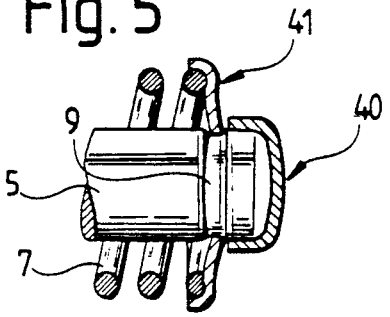
Figure 6:
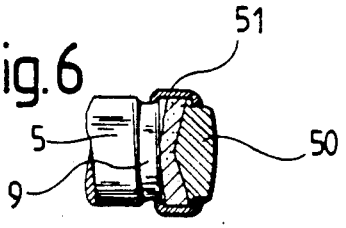
Figure 3A:
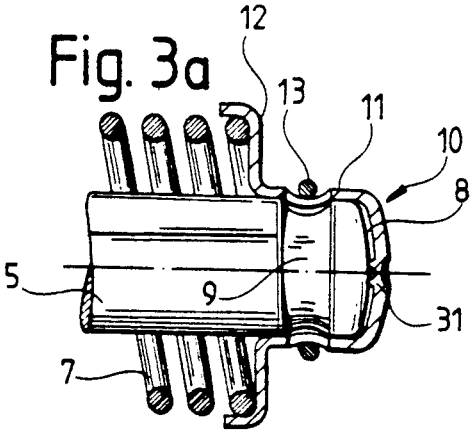
Figure 7:
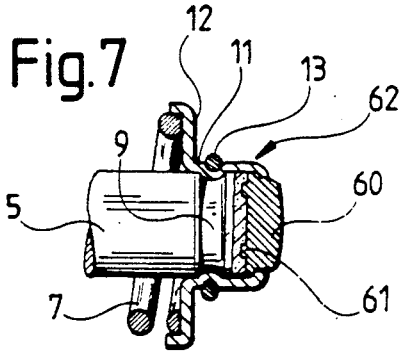
Figure 4:
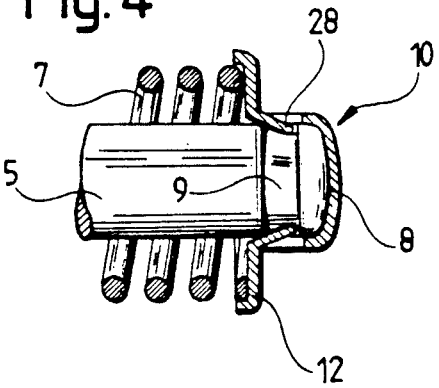
Figure 8:
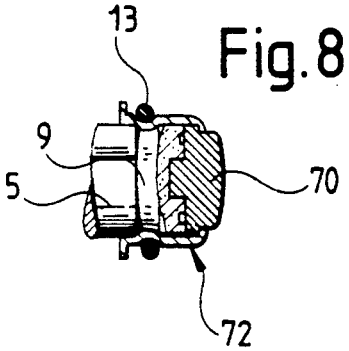
Figure 15:
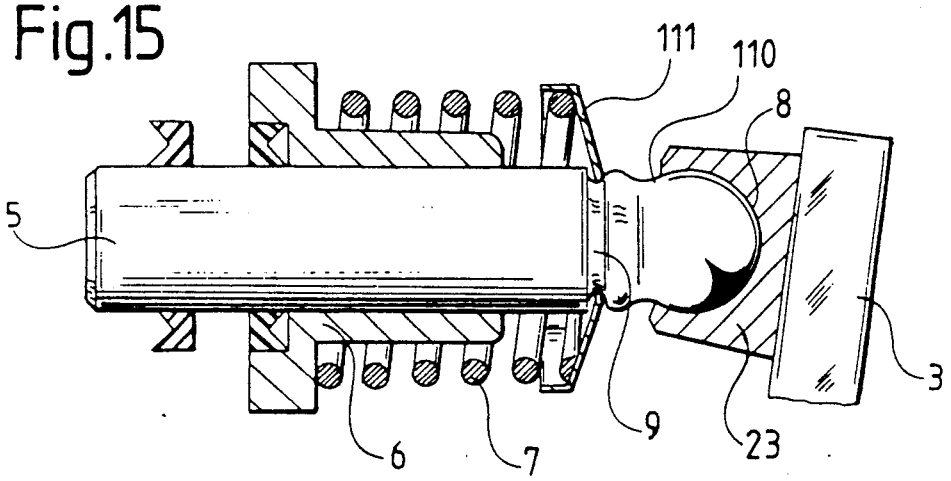
Figure 16:
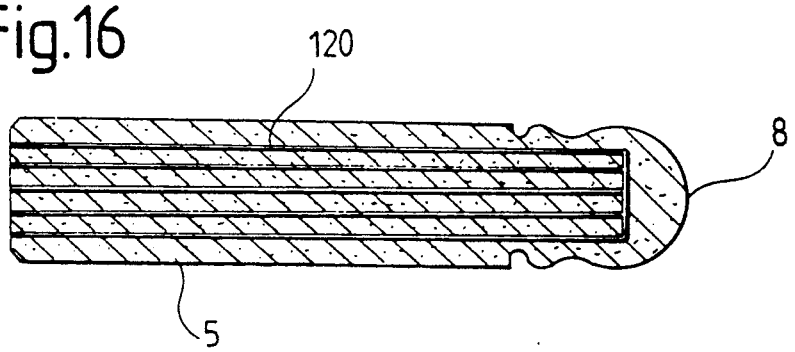

FIG. 3*a* shows the region of contact of a piston with a cap-shaped contact element, with a first supporting element for a spring FIG. 3*b* shows the region of contact of a piston with a cap-shaped contact element, with a second supporting element for a spring;

FIG. 4 shows the region of contact of a piston in accordance with a further embodiment of a contact and supporting element;

FIG. 5 is a view similar to FIG. 4 of a further preferred embodiment of a cap-shaped contact element and a separate supporting element;

FIG. 6 is a view of a piston in the region of contact with a contact element held via a special holding ring;

FIG. 7 is a view similar to FIG. 3 of a further preferred embodiment with a contact element fixed by means of a holding ring;

FIG. 8 is a view similar to FIG. 6 of a further preferred embodiment of a holding ring;

FIG. 9 is a view similar to FIG. 2 of a spherical contact element which is mounted in a cup-shaped recess in the piston;

FIG. 10 is a side view of a piston with a mushroom-shaped contact element;

FIG. 11 is a view similar to FIG. 10 of a contact element which is secured against rotation;

FIG. 12 is a view of the region of contact of a piston with a cap-shaped contact element which is secured against rotation by axial beads axial grooves in the piston;

FIG. 13 is a view in the direction of arrow A in FIG. 12;

FIG. 14 is a view similar to FIG. 12 of a cap-shaped contact element in the form of a turned part which is secured against rotation;

FIG. 15 is a view similar to FIG. 2 of a piston with a spherical end and a contact element in the form of a sliding block; and FIG. 16 is a longitudinal sectional view of a piston with a reinforcement inlay.

The wobble plate piston pump illustrated only partially in the drawings is part of a high-pressure pump in a high-pressure cleaning apparatus comprising an electric motor, not illustrated in the drawings, via which one or several pistons are reciprocatingly displaced in the axial direction. These pistons plunge into a pump chamber, likewise not illustrated in the drawings, with inlet and outlet valves, and in this way convey a cleaning liquid under high pressure to a portable spray pistol or the like.

Figure 1:
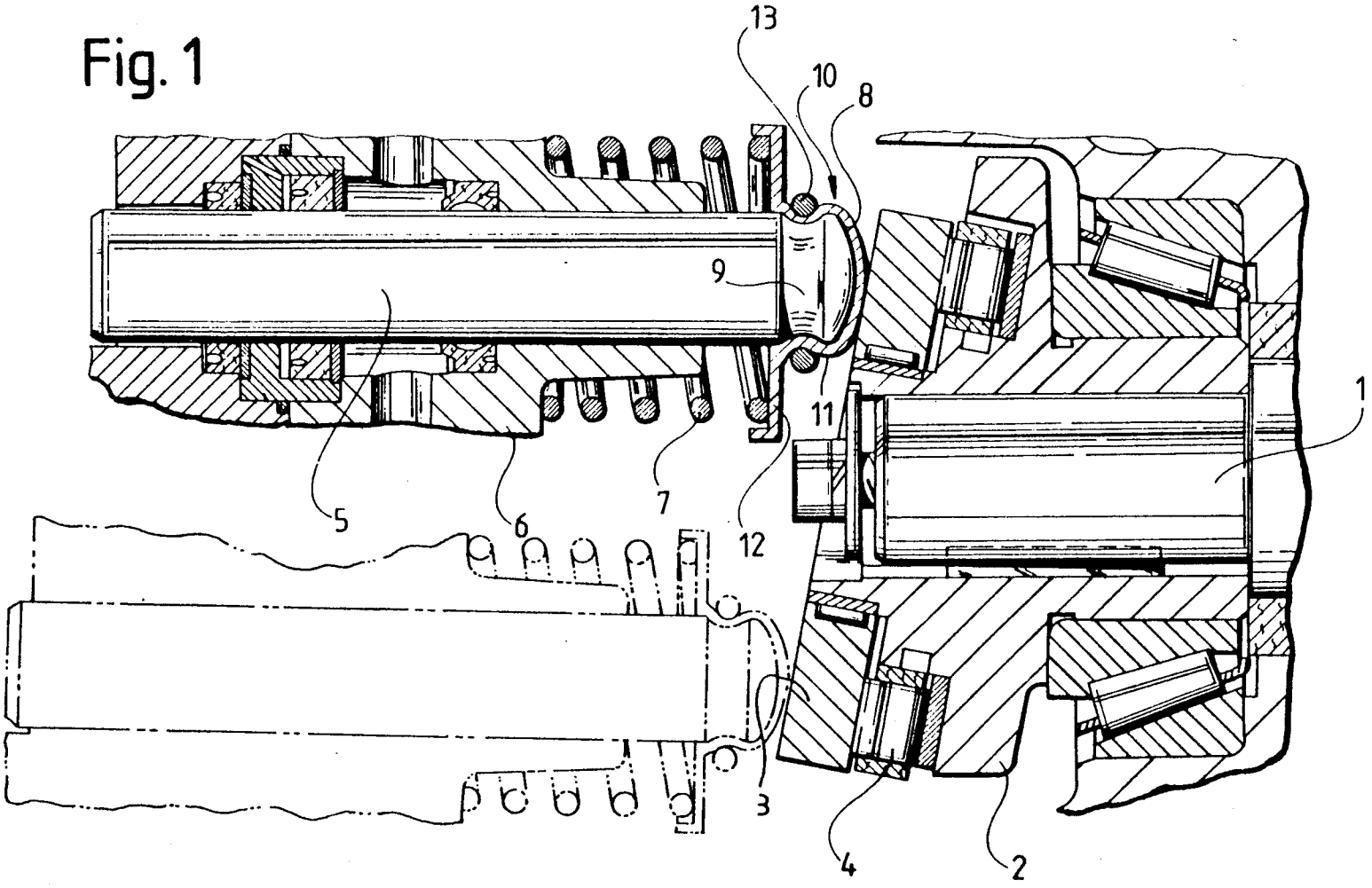
FIG. 1 is a longitudinal sectional illustration of part of a wobble plate piston pump, only a piston and the wobble plate of the pump being shown, with a cap-shaped contact element and a supporting element formed in one piece thereon.

Of the entire arrangement, only those parts are shown in FIG. 1 which are essential to the present invention. A wobble plate carrier 2 is arranged in a rotationally fixed manner on a motor shaft 1 at an incline to the axis of rotation. A pressure disc 3 is rotatably held on the wobble plate carrier 2 by means of a roller bearing 4.

Several pistons 5 of a liquid pump, only one piston of which is illustrated in the drawings, are supported on the pressure disc 3. The piston is mounted for longitudinal displacement in a piston guide 6 on which a compression spring 7 is supported. The compression spring presses the piston 5 elastically against the pressure disc 3 in a manner which will be described in further detail below.

The piston 5 is of circular-cylindrical design and has a rounded-off front face 8 at its end facing the pressure disc 3. In the immediate proximity of this front face 8, the piston 5 has a circumferential groove 9 of arcuate cross-section.

A cap-shaped contact element 10 made of metal fits over the front face 8 with side wall portions 11 of the cap-shaped contact element 10 also covering the circumferential groove 9 completely. At the free end, these wall portions 11 are in the form of a radially protruding flange 12 on which the compression spring 7 is supported and so this flange 12 forms a supporting element for the compression spring 7.

To fix the cap-shaped contact element, which with the one-piece design, a clamping ring 13 made of metal is placed over the wall portions 11 covering the circumferential groove 9. The clamping ring 13 itself is designed as a shrunk-on band, i.e., the clamping ring 13 is heated for pushing-on purposes and thereby expanded It is pushed over the region of the wall portions 11 which covers the circumferential groove 9. During the cooling-down, the clamping ring 13 contracts again and thereby deforms the wall portions 11 located thereunder into the circumferential groove 9 so that these fix the entire contact element on the piston by virtue of engagement in the circumferential groove 9. No further attachment is necessary.

In FIG. 1, the deformation achieved by the clamping ring is exaggerated for reasons of clarity. A circumferential groove with only a minimal depth might also prove adequate for secure fixing.

The manufacture of the piston illustrated in FIG. 1 is extremely simple. If, for example, it is an oxide-ceramic piston, this is preformed and the circumferential groove 9 is cut in the skirt of the piston prior to the firing. After the firing, the piston is ground centerless and so the required external dimensions are achieved with a high degree of precision. The component comprising the actual contact element and the flange for the compression spring is then pushed onto the end of the piston. The thermally expanded clamping ring 13 is pushed over this component into the region of the circumferential groove and merely by virtue of its shrinkage during the cooling-down finally fixes the component on the piston. The piston is then ready for operation.

The clamping rings need not necessarily be thermal shrunk-on rings. Other clamping elements are also possible, for example, wound, fiber-reinforced bands or clamping rings with mechanical clamping capability, i.e., with, for example, a clamping screw.

Various modifications of this structural principle are possible and will be explained below. Parts corresponding to parts illustrated in FIG. 1 bear the same reference numerals in the other Figures.

A contact element 20 comprising a plate-shaped base 21 in contact with the front face 8 of the piston 5 is used in the embodiment of FIG. 2. On its outer side, the base 21 carries a ball 22. This ball is embraced by a sliding block 23 which, in turn, runs on the pressure disc 3. In the illustrated embodiment, a projection 24 of frustoconical shape on the underside of the base 21 engages a corresponding groove 25 in the piston 5.

In this embodiment, a separate holding element 26 is used to fix the base 21 and the ball 22 held thereon on the piston. This holding element 26 is in the form of a sleeve 27 which surrounds the piston end, thereby also covering the circumferential groove 9 of the piston 5, and—like the cap-shaped contact element 10 in FIG. 1—passes over into a flange 12 on which the compression spring 7 is supported. The holding element 26 in the form of a sleeve has in the region in which the circumferential groove 9 is covered inwardly prestressed detent lugs 28 which are cut out of the wall material. These detent lugs 28 penetrate the circumferential groove 9 which in this case is preferably of stepped cross-section. The holding element 26 is thereby secured against withdrawal from the piston after it has been pushed on. At its end 29 opposite the flange 12, the holding element 26 is bent slightly inwards so as to engage over the base 21 in this region and thereby press it against the front face 8 of the piston 5.

In the embodiment of FIG. 2, assembly is also particularly simple. The firing of the piston is carried out in the same manner as with the piston of FIG. 1, with a circumferential groove and with recess 25, and the grinding is performed subsequently. The base 21 carrying the ball 22 is first placed loosely on this piston. The holding element 26 is then pushed onto the piston end in the axial direction until the detent lugs 28 snap into the circumferential groove 9. The base 21 is thereby fixed on the piston. The same applies to the supporting element formed by the flange 12 for the compression spring 7.

The embodiment illustrated in the top half of FIG. 3 corresponds substantially to that of FIG. 1. It differs therefrom only in that the cap-shaped contact element 10 has a central formation 31 which constitutes an inwardly protruding spacer element. This rests against the front face 8 and so the remaining regions of the cap are spaced from the front face 8. These regions which exhibit a certain elasticity can thereby elastically absorb pressure shocks.

The bottom part of FIG. 3 shows a modified embodiment wherein the contact element 10 is not continued in the form of a radially protruding flange 12. A separate ring-shaped supporting element 32 of stepped cross-section which is supported with its inside rim on the clamping ring 13 is provided in this embodiment. The supporting element 32 is always pressed firmly against the clamping ring 13 by the compression spring 7 and in this way is securely fixed on the piston.

In the embodiment of FIG. 3, the wall portions 11 in the region in which the circumferential groove 9 is covered are slotted parallel to the longitudinal direction of the piston in order to facilitate the pulling of the wall portions 11 into the circumferential groove 9 under the clamping force of the clamping ring 13.

The embodiment of FIG. 4 corresponds substantially to that of FIG. 1 with the difference that the contact element is not fixed with the aid of a clamping ring but with the aid of a detent lug 28 as explained with reference to the embodiment of FIG. 2.

In the embodiment of FIG. 5, a cap-shaped contact element 40 is adhered to, shrunk onto or loosely slipped onto the end of the piston 5. A separate ring-shaped supporting element 41 engages the circumferential groove 9. This supporting element 41 may be inserted into this groove by, for example, a shrinking-on operation. In this case, the groove serves merely to hold the supporting element 41 while the contact element 40 is only held in position by the pressing of the piston 5 against the pressure disc 3 insofar as it is not permanently connected to the piston.

A separate contact element 50 which is of wedge-shaped design on its side facing the front face 8 is provided in the embodiment of FIG. 6. This part which protrudes in wedge-shaped configuration engages the complementary front face 8 and so the contact element 50 is held in a rotationally secured manner. A ring-shaped holding element 51 which surrounds the piston region between front face 8 and circumferential groove 9 in the manner of a sleeve is provided for axially fixing the contact element 50 on the piston 5. The holding element 51 is drawn inwards at both ends and thereby, on the one hand, embraces the contact element 50 and, on the other hand, extends into the circumferential groove 9. The contact element 50 is thereby fixed on the piston. This holding element 51 may also be in the form of a shrunk-on part, i.e., in order to attach this holding element, it is thermally expanded and then firmly clamps contact element and piston together during the cooling-down.

In the embodiment of FIG. 7, a contact element 60 similar in design to the contact element 50 of FIG. 6 is again used. In this case, the securing against rotation is achieved by various peg-shaped projections 61 which penetrate complementary recesses in the front face 8 of the piston.

The holding element 62 with which the contact element 60 is fixed on the piston is of the same design in the region in which it contacts the contact element 60 as the holding element 51 in the embodiment of FIG. 6. At the opposite end, however, the holding element 62 corresponds in design to the contact element 10 in FIG. 1. Therefore, like the contact element in FIG. 1, the holding element 62 is held in the circumferential groove 9 with the aid of a clamping ring 13. In addition, the holding element 62 is adjoined by a flange 12 on which the compression spring 7 is supported.

Finally, the embodiment of FIG. 8 corresponds substantially to that of FIG. 7. The contact element 70 illustrated therein comprises for rotational securing purposes a spring which penetrates a corresponding groove in the front face 8. In this embodiment, there is no radially protruding flange 12 and so this holding element 72 does not simultaneously serve to support the compression spring 7.

In the embodiment illustrated in FIG. 9, the contact element is formed by a ball 80 which engages a cup-shaped recess 81 on the front face 8 of the piston 5 and, on the other hand, is embraced by a sliding block 23, as is also the case in the embodiment of FIG. 2. The ball 80 is loosely inserted between piston 5 and sliding block 23 and is held in its position by the piston 5 being pressed against the wobble plate by the compression spring 7. The compression spring 7 is supported on a supporting element 82 which engages the circumferential groove 9 and is substantially identical in design with the supporting element 41 of the embodiment of FIG. 5.

An embodiment of a circular-cylindrical piston 5 is illustrated in FIG. 10. In a planar front face 8, it has a central blind hole 85 in which a central shaft 86 of a mushroom-shaped contact element 87 engages. The latter has a disc-shaped contact part 88 which is of slightly conical design on the side facing away from the piston. The central shaft 86 is formed on the rear side of the contact part 88. This contact element 87 is simply inserted loosely into the blind hole 85 and remains in this position because the piston is pressed against the wobble plate by the compression spring 7 which is not illustrated in FIG. 10. The compression spring 7 may be supported similarly to the way in the embodiment of FIG. 9. FIG. 10 shows merely a corresponding circumferential groove in the piston but not a supporting element held therein for the compression spring.

The embodiment of FIG. 11 differs from that of FIG. 10 only in that the disc-shaped contact part 88 carries in addition to the shaft 86 at least one pin 89 which engages a corresponding recess 90 in the front face 8 of the piston and so the contact element 87 is secured against rotation relative to the piston. p In the embodiment of FIG. 12, a cap-shaped contact element 95 corresponding to the contact element 40 in the embodiment of FIG. 5 fits over the piston. Differently therefrom, the contact element 95 is also secured against rotation about the longitudinal axis of the piston. For this purpose, there is located in the external skirt of the piston an axial groove 96 in which an axial bead 97 in the circumferential surface of the cap-shaped contact element 95 engages. The contact element 95 is otherwise slipped loosely onto the piston 5.

Finally, in the embodiment of FIG. 14, a likewise cap-shaped contact element 99 is formed by a turned part which is placed loosely on the front face of the piston 5. To secure it against rotation, a pin 100 on the contact element 99 engages a corresponding recess 101 in the front face 8 of the piston.

In the embodiment of FIG. 15, the front face 8 of the piston is of spherical design and has a shallow constriction 110 which separates the spherical end from the cylindrical portion of the piston. The spherical end 8 is surrounded by a sliding block 23, as is also the case in the embodiment of FIG. 2. The sliding block 23 embraces the spherical end 8 to such an extent that the spherical end is undetachably held in the sliding block 23. This can be achieved by, for example, the sliding block which may, for example, consist of bronze, being flanged inwardly at its free end. In this embodiment, the sliding block forms the metallic contact element.

The compression spring 7 is supported in the same way as illustrated in FIG. 5 via a supporting element 111 which engages the circumferential groove 9.

Either the contouring of the piston with spherical end, constriction and circumferential groove is carried out prior to the firing or the grinding of the piston is performed accordingly after the firing.

Embedded in the piston illustrated in FIG. 16 and corresponding to that of FIG. 15 is a reinforcement inlay 120 consisting, for example, of steel filaments or glass fibers extending parallel to one another in the longitudinal direction. This reinforcement inlay gives the piston greater strength to withstand torsional and bending stresses. Such an inlay may also be provided in the pistons of the other embodiments.

I claim:

1. A wobble plate piston pump comprising:

a wobble plate;

a plurality of unitary ceramic pistons, each having an end extending from a pump chamber and contacting the wobble plate via a metallic contact element in the form of a cap that fits over said end;

wherein said piston includes a circumferential groove for use in mounting the cap to said end with a holding element that engages said groove; and a clamping ring for maintaining the engagement of said holding element with said groove.

2. A pump in accordance with claim 1 wherein said cap includes a central spacer element that is supported on a front face of said end to space the cap away from said front face.

3. A pump in accordance with claim 1 wherein said cap is secured against rotation by positive engagement with said piston.

4. A pump in accordance with claim 1 wherein said holding element is integral with said cap.

5. A pump in accordance with claim 1 wherein said holding element includes at least one slot in a wall portion thereof for facilitating the pulling of said wall portion into said groove under a clamping force exerted by said clamping ring.

6. A pump in accordance with claim 1 wherein said clamping ring is a shrunk-on metal ring.

7. A pump in accordance with claim 1 wherein said holding element has a detent projection for snapping into said groove when pushed onto said piston end.

8. A pump in accordance with claim 1 wherein said holding element is shrunk onto said piston end for engagement with said groove.

9. A pump in accordance with claim 1 further comprising a spring for pressing said piston against the wobble plate, wherein said holding element includes a support for said spring.

10. A pump in accordance with claim 9 wherein said support has a detent projection for snapping into said groove when pushed onto said piston end.

11. A pump in accordance with claim 10 wherein said holding element and support are of one-piece design.

12. A pump in accordance with claim 9 wherein said holding element and support are of one-piece design.

13. A wobble plate piston pump comprising:

a wobble plate;

a plurality of unitary ceramic pistons, each having an end extending from a pump chamber and contacting the wobble plate via a metallic contact element in the form of a cap that fits over said end;

wherein said piston includes a circumferential groove for use in mounting the cap to said end with a holding element that engages said groove; and a spring for pressing said piston against the wobble plate, wherein said cap further comprises a radially protruding flange facing away from a front face of said end to support said spring.

14. A pump in accordance with claim 13 wherein said holding element is integral with said cap.

15. A wobble plate piston pump comprising:

a wobble plate;

a plurality of unitary ceramic pistons, each having an end extending from a pump chamber and contacting the wobble plate via a metallic contact element in the form of a cap that fits over said end; and a reinforcement inlay embedded in said ceramic piston;

wherein said reinforcement inlay comprises steel filaments extending parallel to one another.

16. A wobble plate piston pump comprising:

a wobble plate;

a plurality of unitary ceramic pistons, each having an end extending from a pump chamber and contacting the wobble plate via a metallic contact element in the form of a cap that fits over said end; and a reinforcement inlay embedded in said ceramic piston;

wherein said reinforcement inlay comprises glass fibers extending parallel to one another.

17. A wobble plate piston pump comprising:

a wobble plate;

a plurality of unitary ceramic pistons, each having an end extending from a pump chamber and contacting the wobble plate via a metallic contact element;

wherein said metallic contact element is a disc having at least one projection extending into a complementary recess in a front face of said piston end.

18. A pump in accordance with claim 17 wherein said disc is secured against rotation by positive engagement with said piston.

19. A pump in accordance with claim 17 wherein said disc includes a central shaft for penetrating a central blind hole in said piston end.

* * * * *